United States Patent [19]

Salmon et al.

[11] Patent Number: 4,760,941

[45] Date of Patent: Aug. 2, 1988

[54] COMBINATION CONTAINER AND CLOSURE ASSEMBLY

[75] Inventors: Pierre Salmon, Lozanne; Claude Pradinas, Fontainessur Saone; Jimmy Louvatiere, Lozanne, all of France

[73] Assignee: Societe Nouvelle de Bouchons Plastiques, Anse, France

[21] Appl. No.: 35,362

[22] Filed: Apr. 7, 1987

[30] Foreign Application Priority Data

Apr. 9, 1986 [FR] France ..... 86 05248

[51] Int. Cl.[4] ..... B67B 5/00

[52] U.S. Cl. ..... 222/153; 222/83; 222/541; 215/256

[58] Field of Search ..... 222/153, 542, 541, 91, 222/83, 544, 548, 549; 215/232, 249, 351, 250, 252, 256, 255; 220/319

[56] References Cited

U.S. PATENT DOCUMENTS 3,901,404 8/1975 Feldman ..... 215/256
3,980,195 9/1976 Fillmore ..... 215/256
4,307,821 12/1981 McIntosh ..... 222/83
4,362,253 12/1982 Wortley et al. ..... 215/256
4,583,665 4/1986 Barriac ..... 222/153

*Primary Examiner*—Joseph J. Rolla
*Assistant Examiner*—Kenneth Noland
*Attorney, Agent, or Firm*—Dowell & Dowell

[57] ABSTRACT

A combination closure assembly and container wherein the threaded neck of the container includes two series of notches along the base thereof and wherein the closure is provided with a tamper indicating guarantee strip which is lockingly engaged with a first of the series of notches so that the strip will be severed from the remaining portion of the closure assembly if access is attempted into the container and wherein the closure assembly also includes a conical sleeve which is engageable with the second of the series of notches upon the severance of the guarantee strip in such a manner as to prevent the closure assembly from being removed from the container.

8 Claims, 6 Drawing Sheets

COMBINATION CONTAINER AND CLOSURE ASSEMBLY

BACKGROUND OF THE INVENTION

1. Field of the Invention

The present invention relates to a combination of an endpiece or closure assembly and a recipient or container.

2. History of the Related Art

It is known that producers of products contained in dispensers do not want such dispensers to be filled with a rival product after the initial contents thereof have been used up.

British Pat. No. 2 100 237 discloses a bottle provided with a sealed, threaded neck cooperating with a pourer stopper capable, when it is completely screwed on the neck, of perforating the seal closing the neck and of cooperating with means preventing unscrewing thereof.

However, such a combination presents the drawback of not ensuring immobilization of the stopper during storage, with the result that, if the stopper is screwed by error, the seal is perforated which, if the product contained in the bottle is perishable, risks provoking irreversible degradation thereof.

French Pat. No. 2 236 748 also discloses a closure adapted to be screwed on the sealed neck of a container but which, because of the presence of a tear-off strip, prevents this closure from being completely screwed on the neck and thereby severing the seal. The device according to this Patent therefore protects the product stored, but cannot avoid the container being filled after the initial contents have been used up. In addition, the only guarantee given concerns the integrity of the seal, but it may be assumed that ill-disposed individuals may have access to the initial contents by destroying the seal during storage.

Finally, French Pat. No. 2 205 451 discloses a stopper of which the tear-off guarantee strip is provided with internal teeth adapted to cooperate with notches located at the base of the neck of a container so that this stopper cannot be unscrewed without the guarantee strip being destroyed.

SUMMARY OF THE INVENTION

It is an object of the improvements forming the subject matter of the present invention to enable a closure assembly mounted on a recipient or container with a covering seal to be produced, which ensures an absolute guarantee of the quality of the initial contents, i.e. a guarantee or tamper indicating strip must be broken in order to have access to the contents, and which, in addition, avoids with certainty that the container may be filled with any product after the initial contents have been used up.

BRIEF DESCRIPTION OF THE DRAWING

The invention will be more readily understood on reading the following description with reference to the accompanying drawings, in which.

DESCRIPTION OF THE PREFERRED EMBODIMENT

Figure 1:
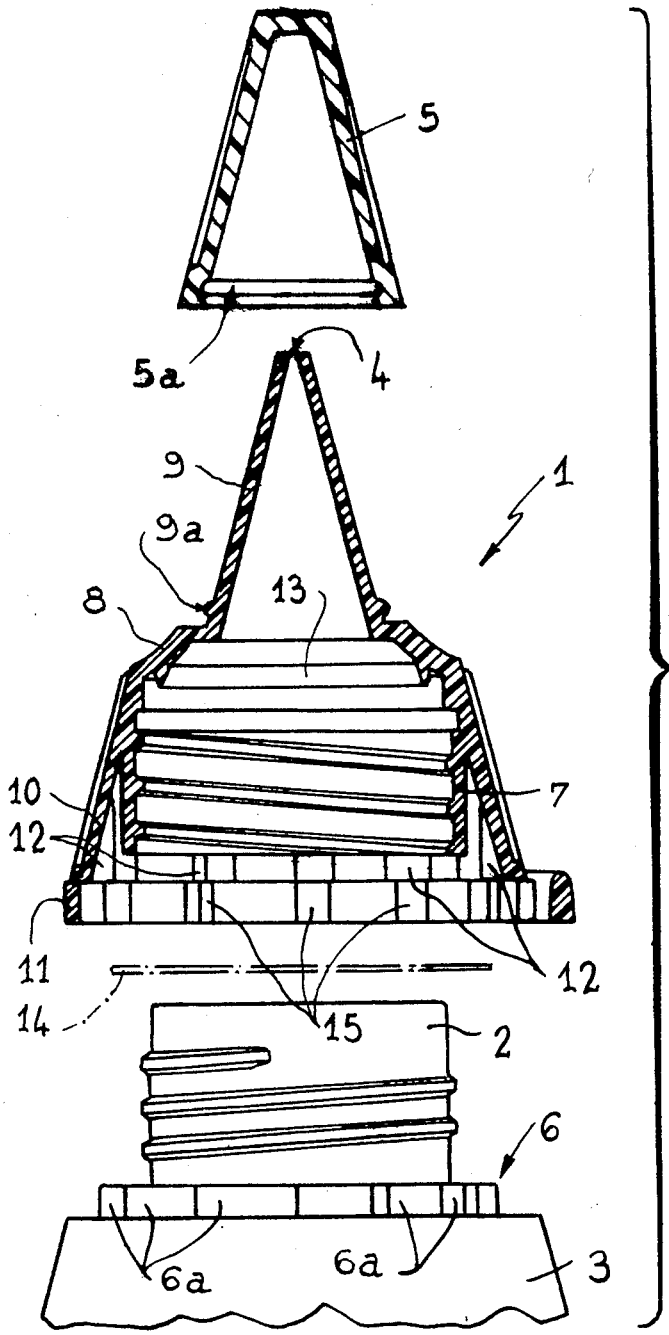
FIG. 1 is an exploded view in longitudinal section of the different elements of a combination according to the invention.

Referring now to the drawings, the Figures show an endpiece or closure, generally referenced 1, adapted to cooperate with the threaded neck 2 of a recipient or container 3. To produce a combination according to the invention, the closure 1, which is generally truncated in shape, comprises a terminal opening 4 closed by a cap 5.

The base of the neck 2 comprises a peripheral ring 6 provided with a series of radial teeth **6*a*** facing the centre and made in the manner of those of a ratchet wheel, as will be explained hereinbelow.

The closure 1 comprises a central skirt 7 provided with an inner tapping adapted to cooperate with the thread of the neck 2. This skirt extends upwardly to constitute an oblique shoulder 8 connecting it to a conical nozzle 9 of which the apex comprises the opening 4.

The skirt 7 is surrounded by a truncated sleeve 10 issuing from the shoulder 8 and which comprises at its base a larger diameter than that of the neck 2. The base of the closure 1 is associated, by means of a line of lesser thickness, with a tear-off tamper indicating guarantee strip 11. Above this strip, the inner wall of the sleeve 10 is provided with at least one tooth 12. In fact, there is a series of teeth 12 distributed equally over the whole periphery of the inner face of the sleeve and of which the shape will be better described hereinbelow.

It will be observed that, beneath the shoulder 8 lies a downwardly facing lip 13. The base of the nozzle 9 comprises a bead **9*a* which engages in a groove 5*a* in the cap 5 when the latter covers the nozzle 9**.

Figure 2:
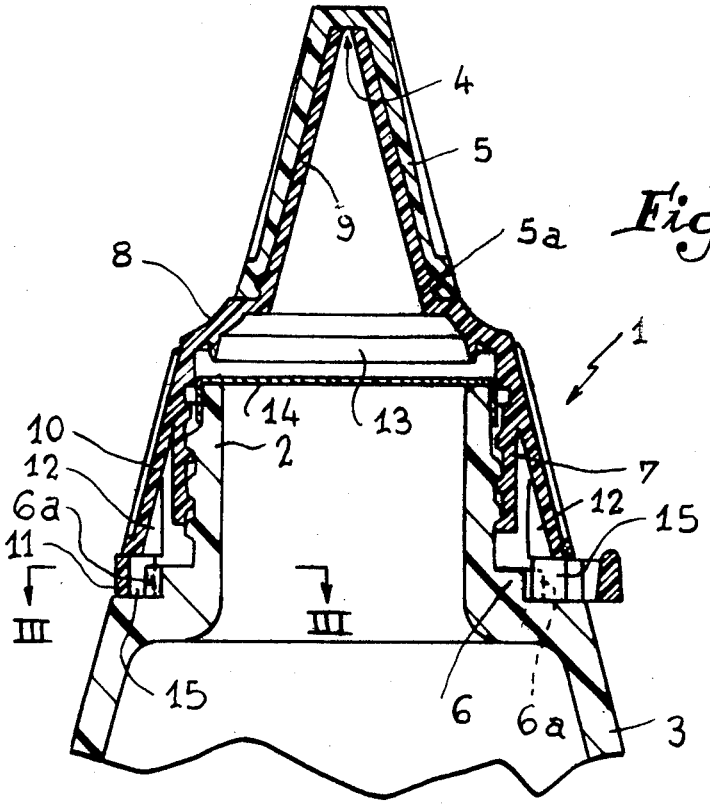
FIG. 2 illustrates the way in which the closure assembly is mounted on the recipient before the guarantee seal thereof is destroyed.

It will be noted that a seal 14, illustrated in broken lines in FIG. 1, may be welded on the opening of the neck 2, as illustrated in FIG. 2.

This Figure shows the closure 1 screwed on the neck 2, so that the guarantee strip 11 rests on the container 3 around its ring 6. Screwing of the closure is limited by abutment of the strip 11 on the shoulder surrounding the ring 6.

Figure 3:
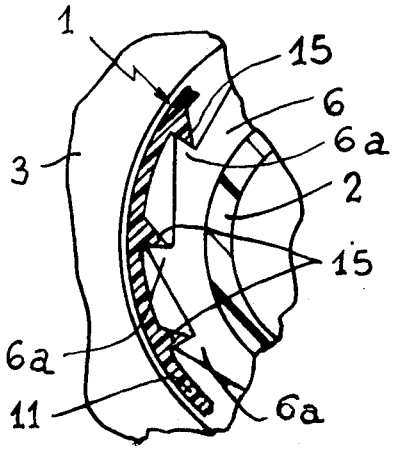
FIG. 3 is a section along III—III (FIG. 2).

In a first embodiment, the inside of the strip 11 comprises teeth 15 with asymmetrical profile, so that the endpiece can be screwed on the neck 2 in known manner by slanting the teeth 15 with respect to those **6*a* of the ring 6 of the container 3 (FIG. 3). In this way, it is impossible to unscrew the closure 1 before destruction of the strip 11 which therefore constitutes an additional guarantee of the authenticity of the product contained in the container 3. In fact, infringers might well tear off the seal 14 to fill the recipient 3 with a non-authentic product, then weld a new seal on the opening of the neck. The presence of teeth 15 on the strip 11** prevents any action of this type.

Figure 4:
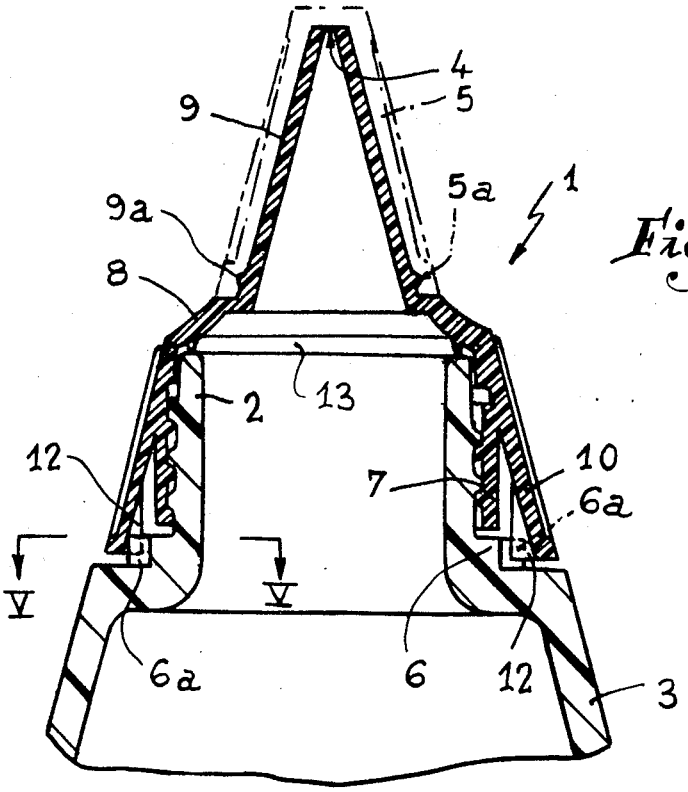
FIG. 4 is a view similar to that of FIG. 2, but illustrating the closure in its position of use after the guarantee seal has been destroyed.

After the strip 11 has been destroyed, the closure can be unscrewed, the seal 14 torn off and the closure rescrewed until the teeth 12 of its conical sleeve 10 cooperate with the teeth **6*a* of the ring 6 of recipient 3, as illustrated in FIG. 4, such cooperation being made possible by the disappearance of the strip 11 making it possible to screw the closure further with respect to the neck. At that moment, the lip 13** bears on the endpiece of the neck to constitute a seal between these two pieces.

Figure 5:
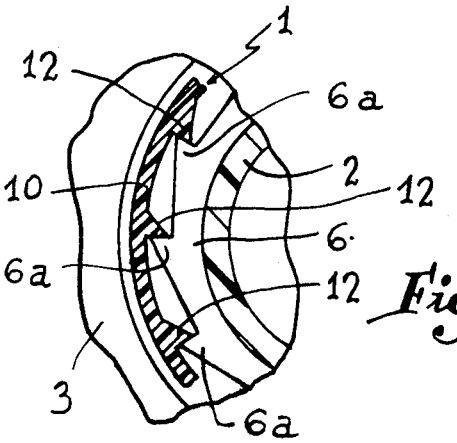
FIG. 5 is a section along V—V (FIG. 4).

As illustrated in FIG. 5, the teeth 12 of the sleeve 10 have a slanting form identical to those 15 of the guarantee strip 11, with the result that the endpiece can be screwed, but unscrewing thereof is impossible without destroying the base of the conical sleeve 10, as is known.

It goes without saying that the closure must be made of an elastic matter such as a plastics material of the polyethylene or polypropylene type, so that the teeth 15 and/or 12 present the desired elasticity.

Figure 6:
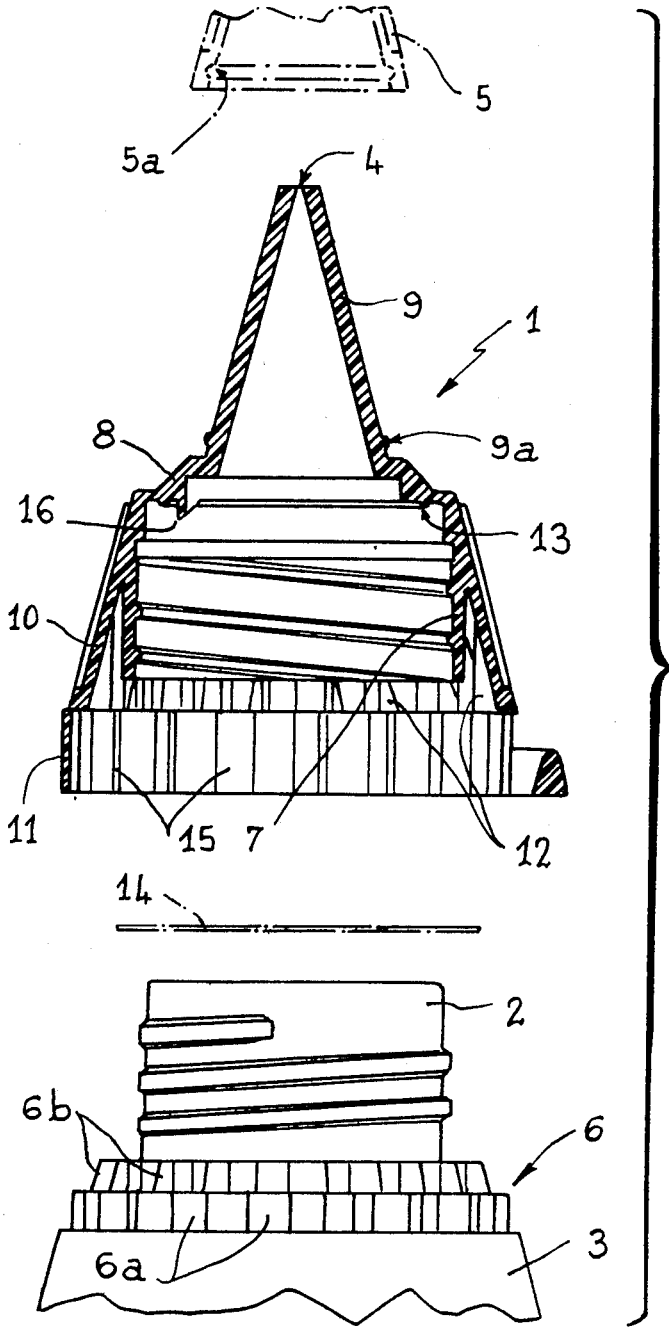
FIG. 6 is a view similar to that of FIG. 1, but illustrating a variant embodiment.

As illustrated in the variant embodiment of FIG. 6, the ring 6 disposed at the base of the neck 2 is stepped so that, above a first row of teeth 6*a*, there is located a second row 6*b* disposed on a part of the ring of smaller diameter.

In addition, the lip 13 is extended by an axial tooth 16.

Figure 7:
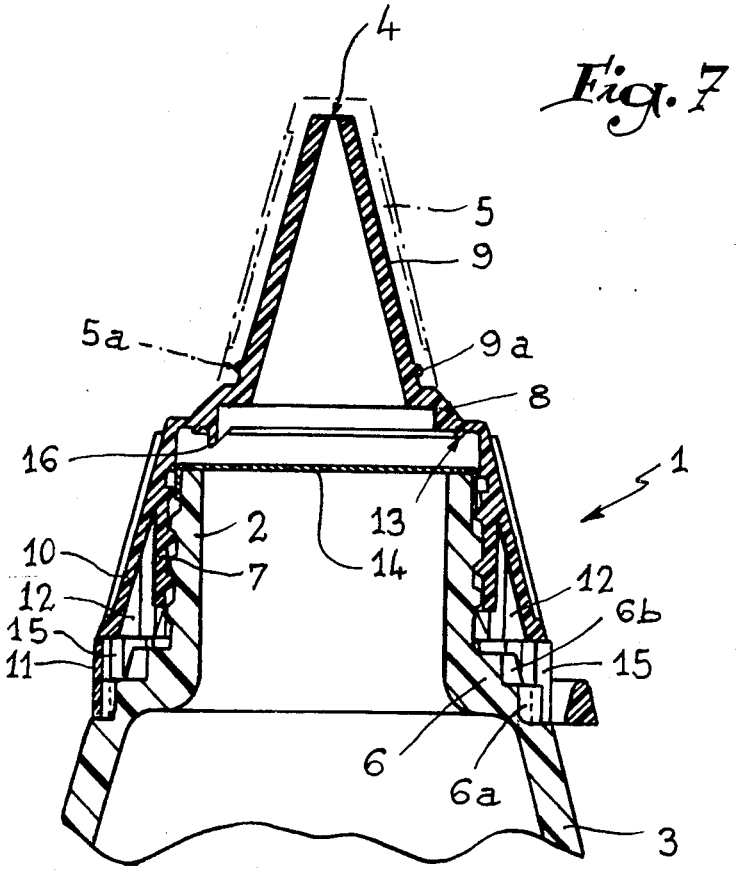
FIGS. 7 and 8 are views corresponding to those 2 and 4 of the first embodiment according to the invention.
Figure 8:
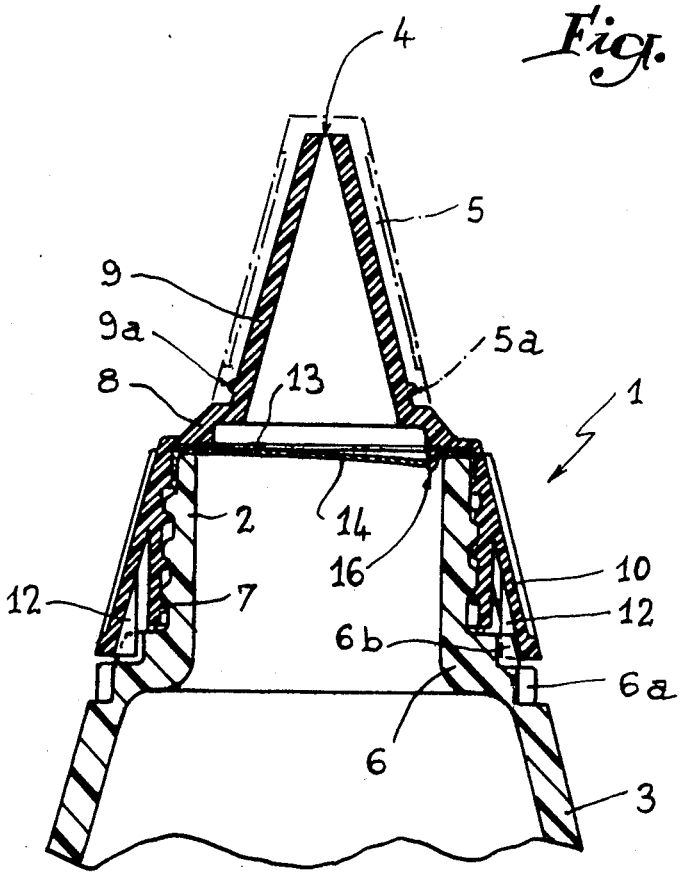

As illustrated in FIG. 7, when the closure 1 is screwed on the neck 2, the slanting teeth 15 disposed on the inner face of the tear-off guarantee strip 11 cooperate with the notches 6*a* of the ring 6, as illustrated in FIG. 3, with the result that it is impossible to dismantle the endpiece 1 without tearing the strip 11. In this way, the authenticity of the contents of the recipient 3 is guaranteed since an infringer could not change the product after having torn or unwelded the seal 14.

This position of the endpiece is the one which it occupies for the whole duration of storage of the container 3 before its contents are used.

Once the container 3 has been arranged so that its contents can be used, it is necessary to tear the guarantee strip 11 by separating it from the conical sleeve 10 of the closure. In this way, the distance piece preventing the complete screwing of the endpiece with respect to the thread of the neck 2 is eliminated, with the result that this operation can then be carried out to bring the closure into the position illustrated in FIG. 7.

Such screwing brings about cooperation of the slanting teeth 12 formed inside the conical sleeve 8 with the second row of notches 6*b* as indicated hereinabove with reference to FIG. 4, with the result that, from that moment, it is impossible to separate the closure 1 from the container 3 by unscrewing.

Thanks to the presence of the finger 16 lying on a radius corresponding to the inside one of the neck 2, the cut-out is obtained of at least a part of the seal 14 previously welded on the opening of the neck 2, with the result that the initial contents of the container 3 may then be poured out for example by compression thereof.

A combination of an closure and of a container has thus been produced, which allows two distinct and successive functions, namely on the one hand, the guarantee of the authenticity of the product contained in the container as long as the latter is stored and, on the other hand, the impossibility of filling the container again once the initial contents have been used up.

What is claimed is:

1. A combination container and closure assembly comprising a container having a threaded neck portion, first and second generally concentric and vertically spaced teeth means surrounding said neck portion, a closure assembly threadingly engageable with said neck portion, said closure assembly including a generally annular sleeve means, a tear strip seal means extending outwardly of said sleeve means, said seal means having first locking means for selectively engaging said first teeth means so as to prevent the removal of said closure assembly from said neck portion without at least partially severing said tear strip seal means from said sleeve means when said closure assembly is in a first threaded position with respect to said neck portion, said sleeve means including second locking means for selectively engaging said second teeth means so as to prevent the rotational separation of said closure assembly from said neck portion when said closure assembly is in a second threaded position with respect to said neck portion, said tear strip seal means normally spacing said second locking means from said second teeth means until said tear strip seal means is severed from said sleeve means whereupon said closure assembly may be adjusted to said second position whereby said tear strip seal means provides a visual indication of tampering with said closure assembly and said second locking means of said sleeve means prevents access to within said container.

2. The combination container and closure assembly of claim 1 in which said neck portion includes an opening, a protective seal covering said opening, said closure assembly including severing means extending inwardly thereof, said severing means being spaced from said protective seal when said closure assembly is in said first position and penetrating said protective seal when said closure assembly is in said second position.

3. The combination container and closure assembly of claim 2 in which said closure assembly includes a generally cylindrical skirt portion spaced inwardly of said sleeve means, said skirt portion having an inner surface, and screw threads provided along said inner surface of said skirt portion for cooperatively engaging said neck portion of said container.

4. The combination container and closure assembly of claim 3 including nozzle means extending outwardly of said sleeve means, a discharge opening within said nozzle means, and cap means for selectively closing said opening in said nozzle means.

5. The combination container and closure assembly of claim 3 in which said first locking means includes a plurality of annularly oriented teeth, said teeth intermeshing with said first teeth means in a ratchet-like manner so as to permit the closure of the closure assembly relative to said neck portion but prohibiting the removal of said closure assembly without severing said seal means.

6. The combination container and closure assembly of claim 5 in which said second locking means includes a plurality of annularly oriented teeth which intermesh with said second teeth means in ratchet-like manner so as to permit the tightening of said closure assembly relative to said neck portion but preventing the removal of said closure means from said neck portion.

7. A combination container and closure assembly for providing evidence of tampering and for preventing the reuse of the container comprising a container having an end portion, a threaded neck extending outwardly from said end portion and having a base and outer rim portions, first beveled teeth means spaced about said base of said neck, second beveled teeth means spaced radially inwardly of said first teeth means and spaced from said base of said neck, a closure assembly, said closure assembly including a skirt portion having first and second ends and a threaded inner wall, said threaded inner wall being threadingly engageable with said threaded neck portion, an annular sleeve extending outwardly of said skirt portion and having a base portion extending beyond said second end of said skirt portion, a tamper indicating seal means extending outwardly from said base portion of said sleeve, said tamper indicating seal means including third beveled teeth means for selectively engaging said first teeth means so as to permit rotation in a first direction but to prohibit rotation in a reverse direction, said tamper indicating seal means being severable with respect to said base portion of said sleeve when said closure assembly is rotated in said reverse direction, said tamper indicating seal means normally retaining said closure assembly in a first position relative to said neck portion, said closure assembly being threadingly adjustable to a second position upon the severance of said tamper indicating seal means, and fourth beveled teeth means carried by said sleeve means, said fourth beveled teeth means being engageable with said second teeth means of said container so as to permit rotation of said closure assembly in said first direction but to prohibit rotation of said closure assembly in said reverse direction.

8. The combination container and closure assembly of claim 7 in which said rim of said neck portion of said container defines an opening, a protective seal covering said opening, said closure assembly including a severing member, said severing member being spaced from said protective seal when said closure assembly is in said first position and being generated through said protective seal when said closure assembly is in said second position.

* * * * *